US006615013B2

(12) United States Patent
Arai et al.

(10) Patent No.: US 6,615,013 B2
(45) Date of Patent: Sep. 2, 2003

(54) POWDER CLASSIFYING DEVICE AND IMAGE FORMING APPARATUS HAVING THE POWDER CLASSIFYING DEVICE

(75) Inventors: Yuji Arai, Kawasaki (JP); Satoshi Takano, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/996,752

(22) Filed: Nov. 30, 2001

(65) Prior Publication Data

US 2002/0067932 A1 Jun. 6, 2002

(30) Foreign Application Priority Data

Nov. 30, 2000 (JP) ..... 2000-365659
Nov. 16, 2001 (JP) ..... 2001-352045

(51) Int. Cl.[7] ..... G03G 15/08; G03G 21/10
(52) U.S. Cl. ..... 399/253; 399/358; 399/359
(58) Field of Search ..... 399/253, 358–360

(56) References Cited

U.S. PATENT DOCUMENTS 4,054,381 A * 10/1977 Bernhard ..... 399/359
5,200,788 A * 4/1993 Thayer ..... 399/359
5,710,960 A * 1/1998 Hart et al. ..... 399/253

FOREIGN PATENT DOCUMENTS

JP 10-207236 8/1998
JP 10-260583 9/1998

* cited by examiner

*Primary Examiner*—William J. Royer
(74) *Attorney, Agent, or Firm*—Oblon, Spivak, McClelland, Maier & Neustadt, P.C.

(57) ABSTRACT

A powder classifying device that classifies powder includes a mesh member having meshes, and a brush roller formed with hair-like members and configured to rotate in sliding contact with the mesh member at a predetermined portion in a circumferential direction of the brush roller to push the powder conveyed in a radial direction of the brush roller against the meshes so that the powder is classified into powder passing through the meshes and powder not passing through the meshes.

43 Claims, 12 Drawing Sheets

POWDER CLASSIFYING DEVICE AND IMAGE FORMING APPARATUS HAVING THE POWDER CLASSIFYING DEVICE

CROSS REFERENCES TO RELATED APPLICATIONS

This document claims priority and contains subject matter related to Japanese Patent Application No. 2000-365659 filed in the Japanese Patent Office on Nov. 30, 2000, and Japanese Patent Application No. 2001-352045 filed in the Japanese Patent Office on Nov. 16, 2001, and the entire contents of each of which are hereby incorporated herein by reference.

BACKGROUND OF THE INVENTION

1. Field of the Invention

The present invention relates generally to an electrophotographic image forming apparatus, such as, a copying machine, a printer, a facsimile machine, and other similar devices having a powder classifying device. More particularly, the invention relates to a powder classifying device that classifies powder for reuse.

2. Discussion of the Background

An image forming apparatus, such as, a copying machine, a printer, and a facsimile machine, employs an electrophotographic image forming process. In this type of an image forming apparatus, an electrostatic latent image formed on an image bearing member (e.g., a photoreceptor drum) is developed with powder such as toner (hereinafter called toner as a representative example of powder) to form a visible image (e.g., a toner image). A toner image formed on the image bearing member is transferred to a transfer sheet by a transfer device. Subsequently, the transfer sheet having the toner image is conveyed to a fixing device, and the toner image is fixed onto the transfer sheet under the influence of heat and pressure by the fixing device.

Generally, residual toner that is not transferred to the transfer sheet and remains on the surface of the image bearing member is removed by a cleaning device such as a cleaning blade, and is then collected to a used-toner collecting container for disposal.

Recently, from the viewpoint of environmental protection, there is an increasing demand for effective use of resources. In addition, a cost reduction is desired such as extending the useful lifetime of toner. For these reasons, reuse of the collected toner has been demanded. In order to fulfill these demands, the above-described image forming apparatus employing an electrophotographic image forming process has employed a device that collects residual toner on the image bearing member and returns the collected toner to a developing device and a toner replenishing device for recycling.

When toner is recycled in the above-described image forming apparatus, a paper powder (paper dust) and aggregated small toner having a relatively large particle size may be included in collected toner. When the collected toner is returned to a developing device and a toner replenishing device for reuse in subsequent development, deterioration of image quality, such as, a white spot and a black spot, may be caused due to the paper powder and the aggregated small toner included in the collected toner.

In order to remove the above-described paper powder and aggregated small toner from the collected toner, a background image forming apparatus employs a filter device. However, a filter of the filter device typically tends to be clogged with collected toner.

SUMMARY OF THE INVENTION

According to one aspect of the present invention, a powder classifying device that classifies powder includes a mesh member having meshes, and a brush roller formed with hair-like members and configured to rotate in sliding contact with the mesh member at a predetermined portion in a circumferential direction of the brush roller to push the powder conveyed in a radial direction of the brush roller against the meshes so that the powder is classified into powder passing through the meshes and powder not passing through the meshes.

According to another aspect of the present invention, an image forming apparatus includes an image bearing member configured to bear a latent image, a developing device configured to develop the latent image with powder so as to form a visual image, and a cleaning device configured to remove the powder remaining on the image bearing member. The image forming apparatus further includes a powder classifying device configured to classify the powder removed from the image bearing member by the cleaning device, including a mesh member having meshes, and a brush roller formed with hair-like members and configured to rotate in sliding contact with the mesh member at a predetermined portion in a circumferential direction of the brush roller to push the powder conveyed in a radial direction of the brush roller against the meshes so that the powder is classified into powder passing through the meshes and powder not passing through the meshes. The image forming apparatus further includes a powder conveying device configured to convey the powder passed through the meshes so as to mix with new powder.

Objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
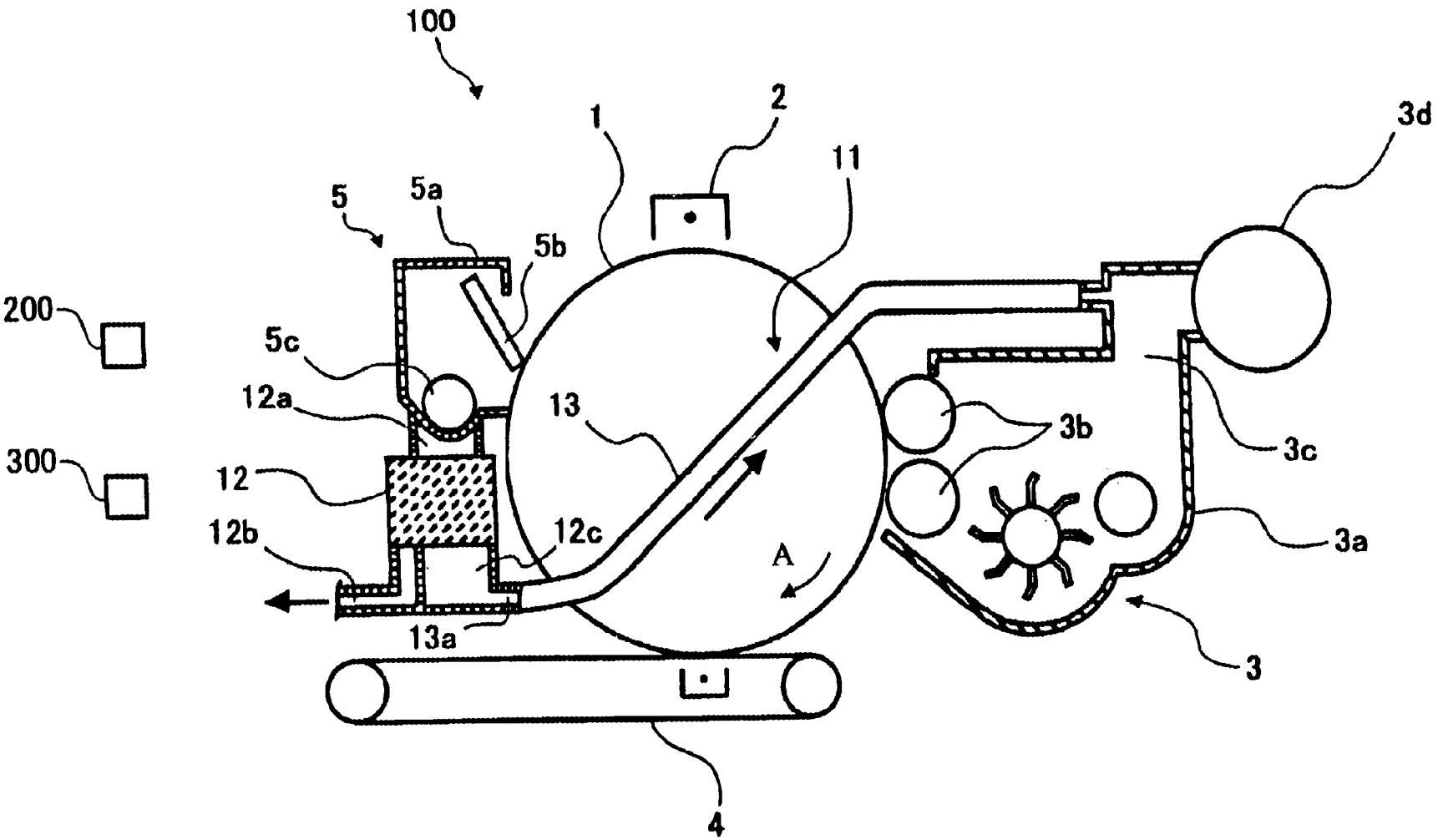
FIG. 1 is a schematic view illustrating a construction of a main part of an image forming apparatus including a toner classifying device according to an embodiment of the present invention.

Preferred embodiments of the present invention are described in detail referring to the drawings, wherein like reference numerals designate identical or corresponding parts throughout the several views.

FIG. 1 is a schematic view illustrating a construction of a main part of an image forming apparatus including a toner classifying device according to an embodiment of the present invention.

An image forming apparatus of FIG. 1 includes an image scanning optical system (not shown) that scans an original image, an image writing optical system (not shown) that provides a scanned image to an image forming unit 100 as an image light, and a sheet feeding system (not shown) that feeds a transfer sheet to the image forming unit 100.

The image forming unit 100 of FIG. 1 that performs an electrophotographic image forming process includes a drum-shaped photoreceptor 1 driven to rotate in a direction indicated by an arrow A in FIG. 1, a charger 2, a developing device 3, a transfer device 4, and a cleaning device 5.

The photoreceptor 1 serving as an image bearing member is uniformly charged by the charger 2. Subsequently, a latent image is formed on the surface of the photoreceptor 1 by the image writing optical system. The developing device 3 develops the latent image on the photoreceptor 1 with toner so as to form a toner image. The transfer device 4 transfers the toner image from the photoreceptor 1 onto a transfer sheet. After the toner image is transferred from the photoreceptor I to the transfer sheet by the transfer device 4, the cleaning device 5 removes the toner remaining on the photoreceptor 1.

The charger 2, the developing device 3, the transfer device 4, and the cleaning device 5 are arranged around an outer peripheral surface of the photoreceptor 1 in the order of the rotational direction of the photoreceptor 1. A toner recycling device 11, that serves to return the toner removed from the surface of the photoreceptor 1 by the cleaning device 5 to the developing device 3 is provided to the image forming unit 100. The returned toner may be reused in subsequent development.

The developing device 3 includes a casing 3*a* accommodating a developing roller 3b, and a toner hopper 3*c* as a toner replenishing part positioned at an upper portion of the casing 3*a*. The developing device 3 further includes a toner bottle 3*d* as a new toner container connected to the toner hopper 3*c*.

The toner recycling device 11 is arranged between the cleaning device 5 and the developing device 3. The toner recycling device 11 includes a toner classifying device 12 connected to the cleaning device 5 so as to classify the toner removed by the cleaning device 5 from the photoreceptor 1, and a toner conveying device 13 that conveys the toner classified by the toner classifying device 12 to the developing device 3.

After image forming operations, the toner removed by the cleaning device 5 is conveyed to the toner classifying device 12 so as to classify the toner into reusable toner and waste toner. Specifically, after an electrophotographic image forming operation is performed in the image forming unit 100, residual toner that is not transferred to a transfer sheet and remains on the surface of the photoreceptor 1 is removed from the surface of the photoreceptor 1 by a cleaning blade 5*b* in a casing 5*a* of the cleaning device 5. The toner removed from the surface of the photoreceptor 1 by the cleaning blade 5*b* is conveyed in a direction perpendicular to the sheet of FIG. 1 by a toner collection coil 5*c* located at a lower part of the cleaning device 5, and is conveyed into the toner classifying device 12 of the toner recycling device 11. The toner conveyed into the toner classifying device 12 is further conveyed to the toner hopper 3*c* of the developing device 3 through the tube-shaped toner conveying device 13 so as to be reused for subsequent development. In the tube-shaped toner conveying device 13, a coil or screw (not shown) is provided to convey the classified toner to the developing device 3 by rotating the coil (screw).

Figure 2B:
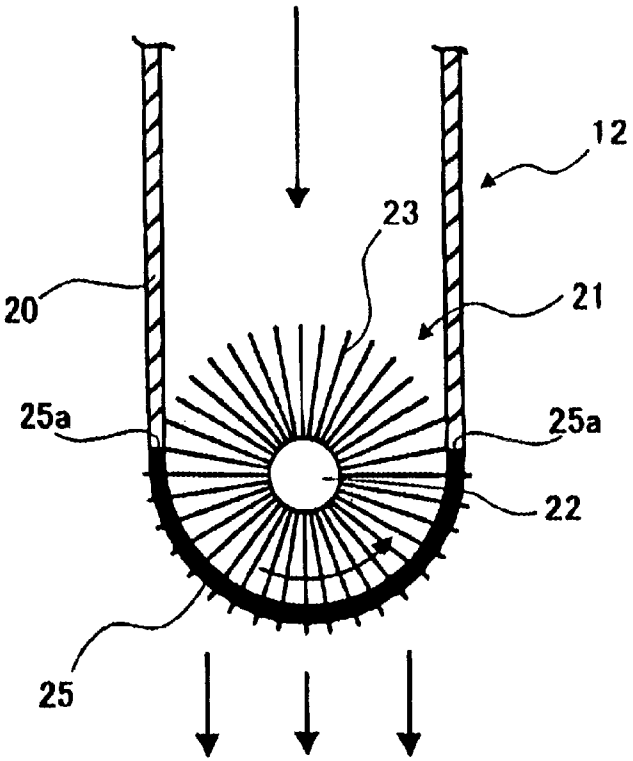
FIG. 2B is a cross sectional view taken along line 2*b*—2*b* of FIG. 2A.
Figure 2A:
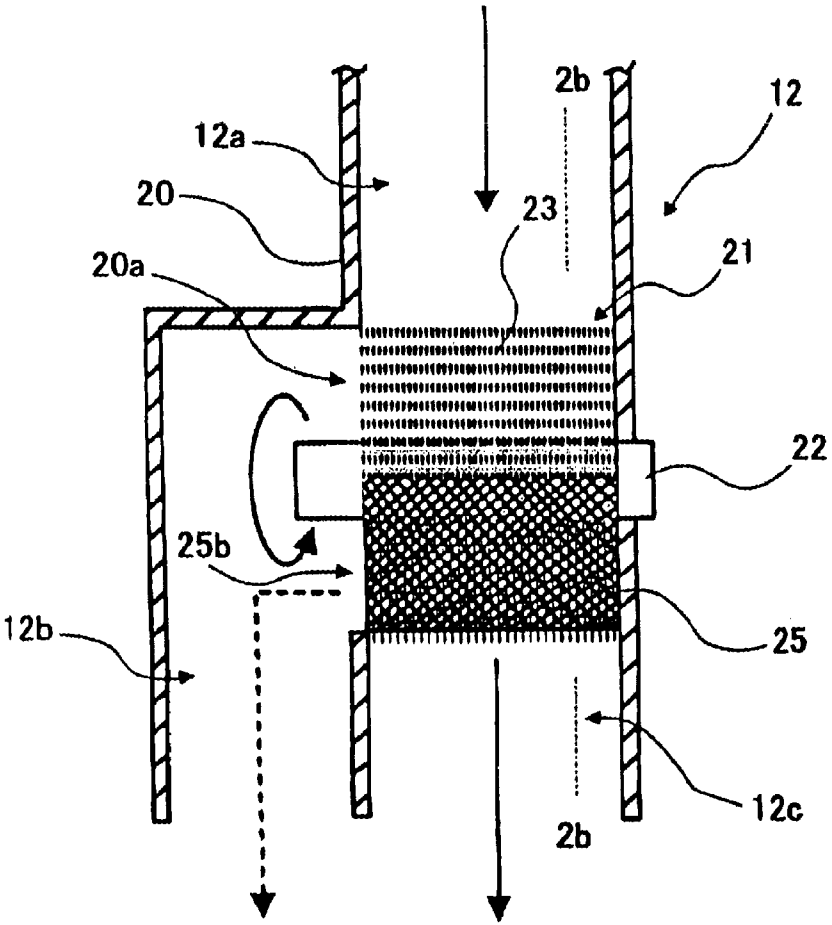
FIG. 2A is a cross sectional view of the toner classifying device taken in a direction substantially perpendicular to an axial direction of a photoreceptor of the image forming apparatus.

FIG. 2A is a cross-sectional view of the toner classifying device 12 taken in a direction substantially perpendicular to an axial direction of the photoreceptor 1. FIG. 2B is a cross sectional view taken along line 2*b*—2*b* of FIG. 2A.

As illustrated in FIGS. 2A and 2B, the toner classifying device 12 includes a case 20 and a brush roller 21. The case 20 houses three paths, such as, a removed toner conveying path 12*a*, a waste toner conveying path 12*b*, and a recycle toner falling path 12*c*. The removed toner conveying path 12*a* and the recycle toner falling path 12*c* are arranged substantially linearly and vertically. The waste toner conveying path 12*b* branches off from the linearly extending removed toner conveying path 12*a* and recycle toner falling path 12*c* in a direction substantially perpendicular to the removed toner conveying path 12*a* and recycle toner falling path 12*c*, and further extends downward in a substantially vertical direction.

The brush roller 21 is arranged such that an axis of the brush roller 21 is substantially parallel to a branch portion

20*a* of the waste toner conveying path 12*b* branching off from the removed toner conveying path 12*a* and the recycle toner falling path 12*c* in a direction substantially perpendicular to the removed toner conveying path 12*a* and the recycle toner falling path 12*c*.

Specifically, the brush roller 21 is arranged such that the brush roller 21 crosses the removed toner conveying path 12*a* and the recycle toner falling path 12*c*. Further, both ends of a brush roller shaft 22 of the brush roller 21 are supported by the case 20 such that the brush roller shaft 22 is substantially parallel to the branch portion 20*a*. The brush roller 21 is driven to rotate by a brush roller drive motor 200 serving as a drive device. The brush roller drive motor 200 is controlled by a motor driver 250 (see FIG. 6).

Moreover, a semicylindrical-shaped mesh member 25 is provided at an opening side of the recycle toner falling path 12*c*, and is arranged such that surface portions of hair-like members 23 of the brush roller 21 are in sliding contact with the mesh member 25.

As illustrated in FIG. 2A, an end portion of the brush roller 21, at a side of the waste toner conveying path 12*b*, is exposed toward the waste toner conveying path 12*b* at the branch portion 20*a*. Further, the brush roller shaft 22 is provided such that the brush roller shaft 22 crosses over the case 20.

Specifically, the brush roller shaft 22 of the brush roller 21 is provided perpendicularly to a toner conveying direction in the removed toner conveying path 12*a*. Further, the brush roller 21 at a side of the recycle toner falling path 12*c* is in sliding contact with the mesh member 25, and a one side end portion 25*b* of the brush roller 21 faces the waste toner conveying path 12*b*.

With the above-described construction of the toner classifying device 12, the removed toner conveyed from an upper half portion side of the brush roller 21 in a radial direction of the brush roller 21 is separately conveyed from the one side end portion 25*b* of the brush roller 21 and from a lower half portion side of the brush roller 21 in the radial direction thereof. In this construction of the toner classifying device 12, the removed toner is classified into toner and paper powder passing through the mesh member 25 and toner and paper powder not passing through the mesh member 25.

The mesh member 25 is a sheet-like member, and is attached to the toner classifying device 12 by fixing both end portions 25*a* of the mesh member 25 substantially parallel to the axial direction of the brush roller 21 to an inner surface of the case 20. Below the mesh member 25, the recycle toner falling path 12*c* connects to an inlet 13*a* of the toner conveying device 13 (illustrated in FIG. 1), and only reusable toner passing through the mesh member 25 falls into the recycle toner falling path 12*c*.

As one non-limiting example of the mesh member 25, the mesh member 25 includes meshes made of metal wire, and a size of each of the meshes of the mesh member 25 is about 150 mesh according to the embodiment of the present invention. The removed toner conveyed into the toner classifying device 12 may be a particle size which is less than the size of each of the meshes of the mesh member 25 and passes through the mesh member 25 while the brush roller 21 rotates in sliding contact with the mesh member 25.

The brush roller 21 also serves to crush aggregated small toner from the toner removed from the photoreceptor 1 by the cleaning device 5 into small particles. The toner passing through the meshes of the mesh member 25 is returned to the developing device 3 through the toner conveying device 13 for reuse in subsequent development.

The waste toner including paper powder and aggregated small toner not passing through the meshes of the mesh member 25 is discharged from the toner classifying device 12 via the branch portion 20*a* and the waste toner conveying path 12*b* by use of vibrations caused by a toner discharging device (not shown). The waste toner discharged from the toner classifying device 12 is conveyed to a used-toner collecting container (not shown) for disposal. The above-described waste toner discharging construction prevents staying and stacking of paper powder and aggregated small toner in the toner classifying device 12.

Figure 3:
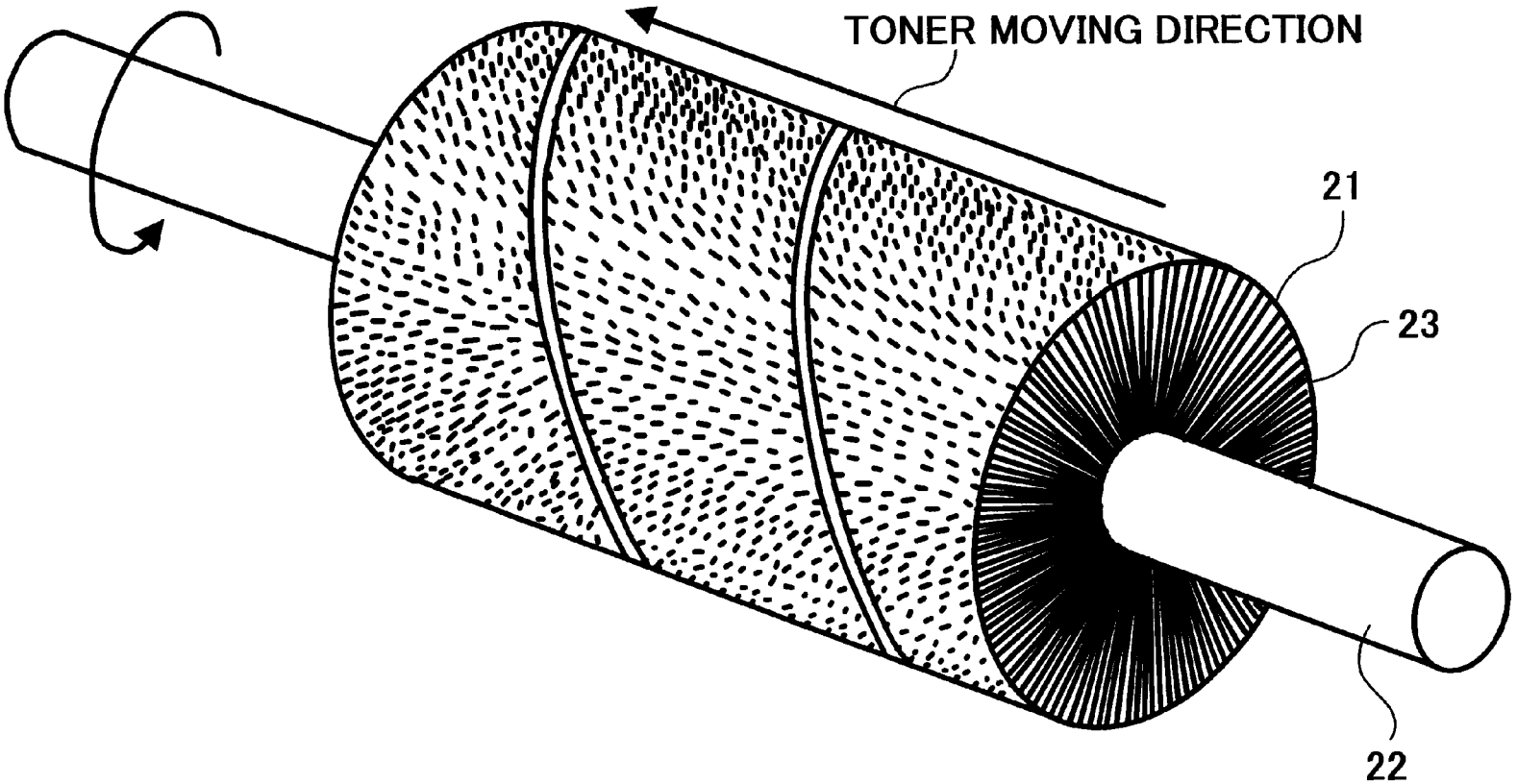
FIG. 3 is a schematic perspective view of a brush roller of the toner classifying device according to the embodiment of the present invention.

In the toner classifying device 12, as illustrated in FIG. 3, a base of the hair-like members 23 of the brush roller 21 is wound around the brush roller shaft 22 such that paper powder and aggregated small toner in the mesh member 25 is moved toward the branch portion 20*a* by rotations of the brush roller 21. Specifically, surface portions of the hair-like members 23 of the brush roller 21 are slanted relative to a rotational direction of the brush roller 21 to move paper powder and aggregated small toner not passing through the meshes of the mesh member 25 in the axial direction of the brush roller 21 toward the branch portion 20*a*. Thereby, the brush roller 21 serves not only to classify toner, but also to discharge paper powder and aggregated small toner from the toner classifying device 12. In this case, it is not necessary that the above-described toner discharging device causes vibrations to the toner classifying device 12. As a result, the construction of the toner classifying device 12 may be made simple and at a low cost.

The hair-like members 23 of the brush roller 21 may be made of any materials so long as the hair-like members 23 include a function of guiding and pushing toner removed from the photoreceptor 1 by the cleaning device 5 against the meshes of the mesh member 25. However, when the hair-like members 23 are formed from a conductive material such as an acrylic/carbon fiber, electric failures, such as charging of toner can be prevented when the hair-like members 23 are in sliding contact with the mesh member 25 while the brush roller 21 is rotated. In this embodiment, the insulation resistance between the hair-like members 23 of the brush roller 21 and the brush roller shaft 22 is set to a range of about $10^{12}\Omega$ or less. For example, the insulation resistance in a range of about $10^{8}\Omega$ to about $10^{12}\Omega$.

Further, each of the hair-like members 23 of the brush roller 21 is substantially straight, and has a thickness smaller than a size of each of the meshes of the mesh member 25. Thereby, tip end portions of the hair-like members 23 of the brush roller 21 may penetrate the meshes of the mesh member 25 when the brush roller 21 pushes toner against the meshes of the mesh member 25. As a result, a failure such as clogging of the meshes of the mesh member 25 with toner may be obviated, so that the toner classifying device 12 may classify toner for a long time.

In this embodiment, a size of each of the meshes of the mesh member 25 is set to a size of a mesh of 150 mesh. Each of the meshes of the mesh member 25 having the size of a mesh of 150 mesh is a quadrilateral of one side about 100 $\mu$m. A thickness of each of the hair-like members 23 of the brush roller 21 is set to about 50 $\mu$m, and is sufficiently smaller than a size of each of the meshes of the mesh member 25.

Further, because the hair-like members 23 of the brush roller 21 are required to include a function of pushing toner against the meshes of the mesh member 25 as described earlier, the hair-like members 23 need to include rigidity strong enough to penetrate the meshes of the mesh member 25.

The brush roller 21 is rotated in a predetermined direction during the classification of toner. While the brush roller 21 continues to be rotated in a predetermined direction, the hair-like members 23 of the brush roller 21 are slanted in the rotational direction of the brush roller 21. As a result, the useful lifetime of the brush roller 21 is shortened, and the toner may not be efficiently classified because a tip end of each of the hair-like members 23 of the brush roller 21 may not penetrate the meshes of the mesh member 25.

In order to solve the above-described failure, the brush roller 21 is controlled to be rotated in a reverse direction by a CPU (central processing unit) 300 through the motor driver 250 at a predetermined timing, such as after completion of an image forming job, after a redetermined number of transfer sheets are copied or printed.

Figure 4A:
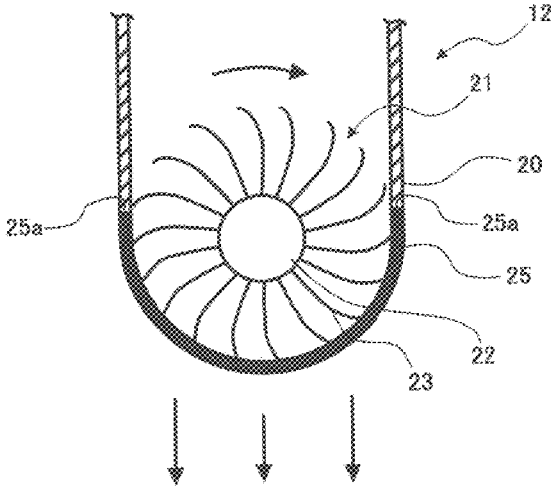
FIG. 4A is a cross sectional view of the toner classifying device when the brush roller is rotated in a forward direction during classification of toner.
Figure 4B:
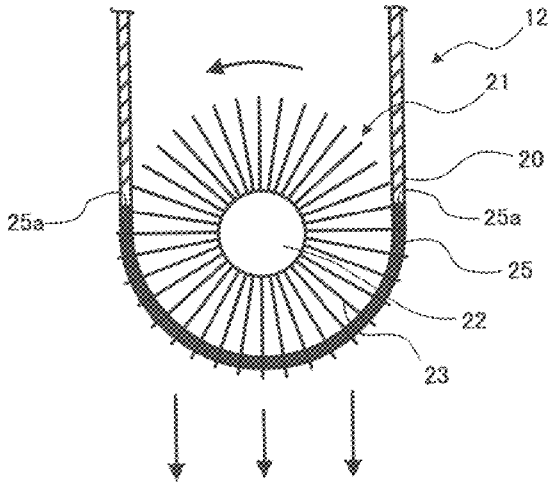
FIG. 4B is a cross sectional view of the toner classifying device when the brush roller is rotated in a reverse direction at a predetermined timing.

FIG. 4A is a sectional view of the toner classifying device 12 when the brush roller 21 is rotated in a forward direction during classification of toner. FIG. 4B is a sectional view of the toner classifying device 12 when the brush roller 21 is rotated in a reverse direction at a predetermined timing.

Figure 5A:
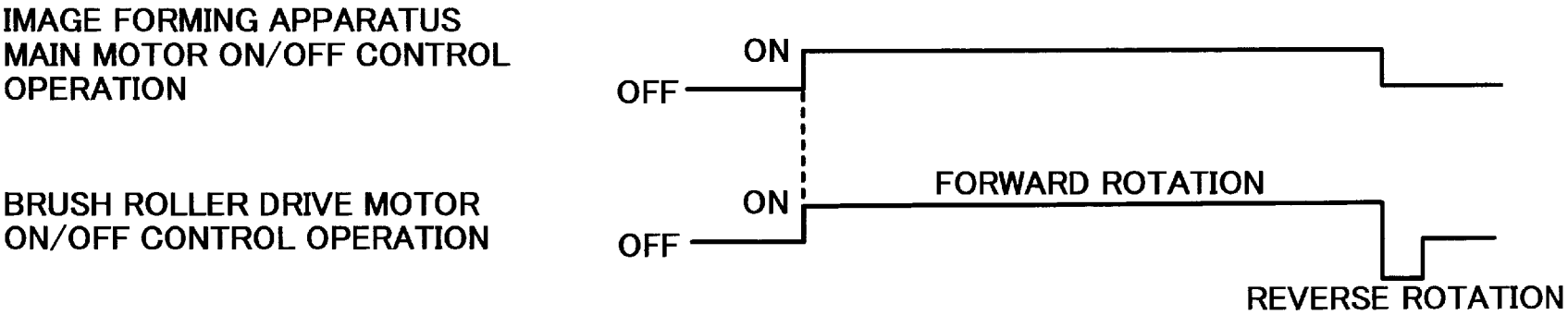
FIG. 5A is a diagram illustrating ON/OFF control operations of an image forming apparatus main motor and brush roller drive motor when the brush roller is controlled to be rotated in a reverse direction after completion of an image forming job.

FIG. 5A is a diagram illustrating ON/OFF control operations of an image forming apparatus main motor and brush roller drive motor when the brush roller 21 is controllably rotated in a reverse direction after completion of an image forming job.

Figure 5B:
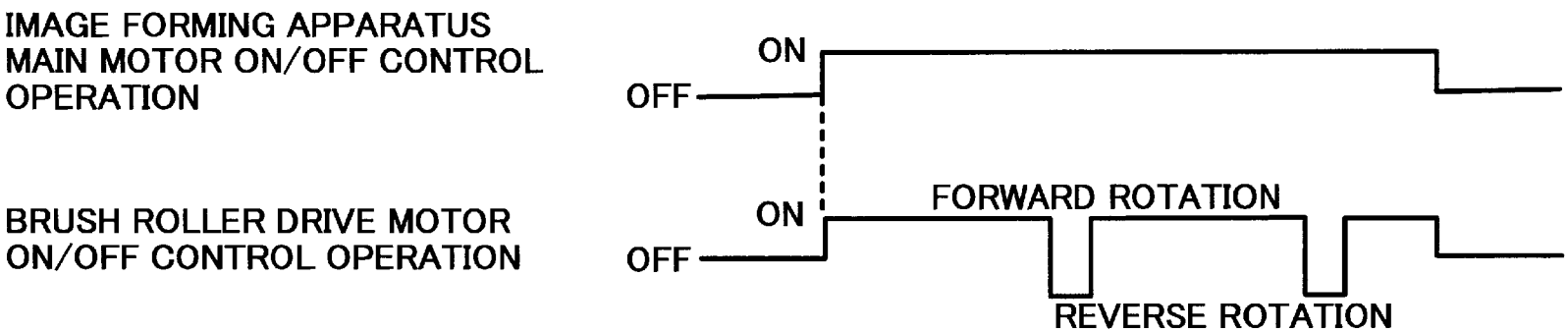
FIG. 5B is a diagram illustrating ON/OFF control operations of the image forming apparatus main motor and brush roller drive motor when the brush roller is controlled to be rotated in a reverse direction after a predetermined number of transfer sheets are copied or printed.

FIG. 5B is a diagram illustrating ON/OFF control operations of the image forming apparatus main motor and brush roller drive motor when the brush roller 21 is controllably rotated in a reverse direction after a predetermined number of transfer sheets are copied or printed.

Figure 6:
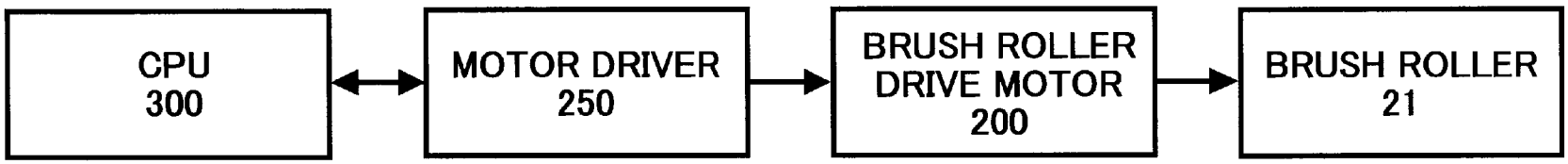
FIG. 6 is a block diagram of a control device, the brush roller drive motor, and the brush roller of the image forming apparatus according to the present invention.

FIG. 6 is a block diagram of a control device, a brush roller drive motor, and a brush roller of the image forming apparatus according to the present invention.

Referring to FIGS. 5A and 6, when the image forming apparatus main motor is turned off (i.e., completion of image forming job), the CPU 300 controls the brush roller drive motor 200 to change rotation in a reverse direction from a forward direction via the motor driver 250, thereby controlling the brush roller 21 to rotate in a reverse direction.

Referring to FIGS. 5B and 6, when a predetermined number of transfer sheets are copied or printed, the CPU 300 controls the brush roller drive motor 200 to change rotation in a reverse direction from a forward direction via the motor driver 250, thereby controlling the brush roller 21 to rotate in a reverse direction.

By controlling the brush roller 21 to rotate in a reverse direction at a predetermined timing, the sliding contact direction of the hair-like members 23 of the brush roller 21 with the mesh member 25 is changed, so that the slanting of the hair-like members 23 of the brush roller 21 caused over the course of time is prevented. Any predetermined timing of controlling the brush roller 21 to rotate in a reverse direction may be set appropriately according to the use condition of the brush roller 21.

Figure 7:
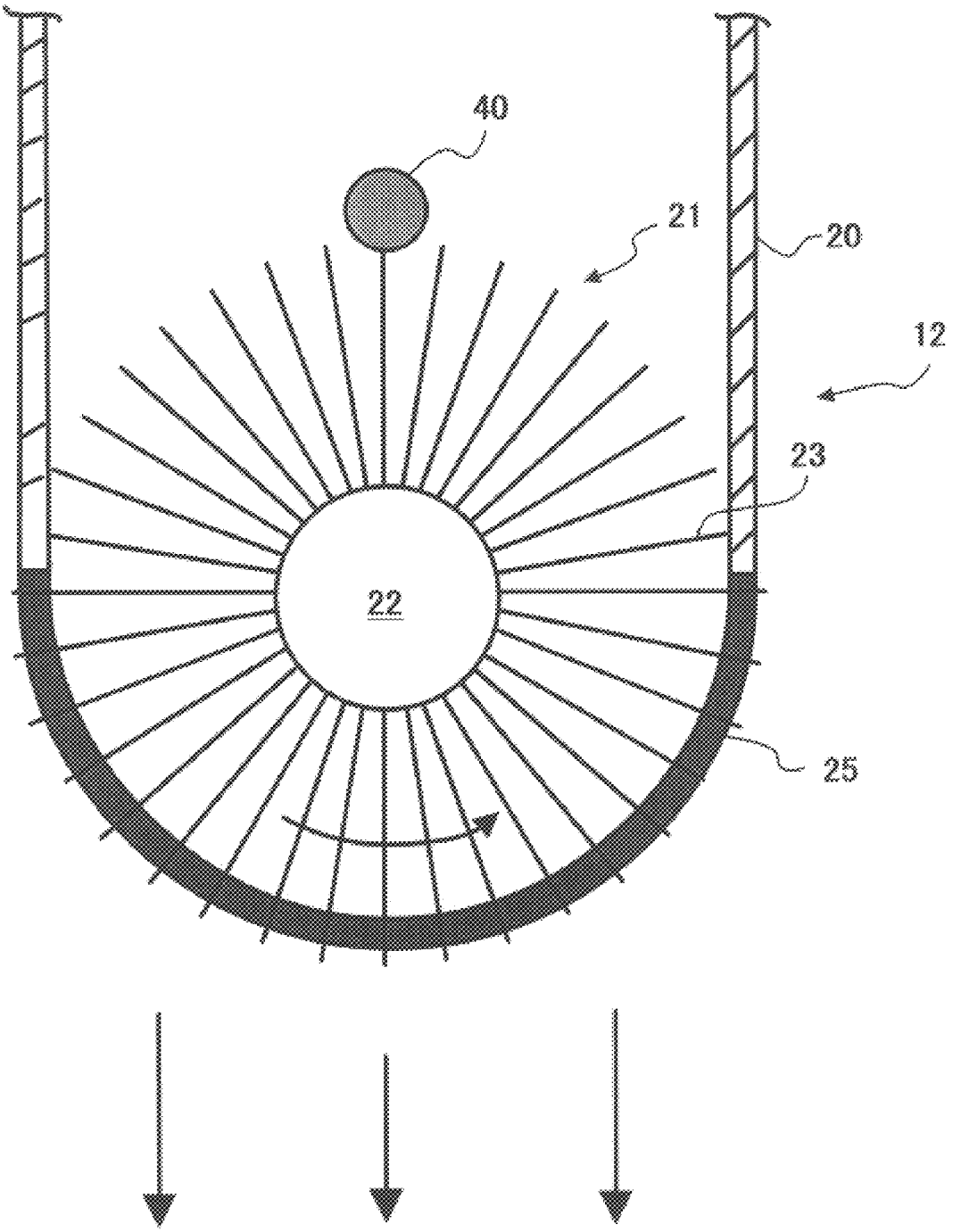
FIG. 7 is a cross sectional view of a main part of the toner classifying device taken in a direction substantially perpendicular to the axial direction of the photoreceptor according to another embodiment of the present invention.

FIG. 7 is a cross sectional view of a main part of the toner classifying device 12 taken in a direction substantially perpendicular to the axial direction of the photoreceptor 1 according to another embodiment of the present. In this embodiment, as illustrated in FIG. 7, a flicker 40 formed from a bar-shaped member such as a stainless bar member is provided in parallel with the brush roller shaft 22 of the brush roller 21 such that the tip end portions of the hair-like members 23 of the brush roller 21 abut the flicker 40. With the provision of the flicker 40, much of the toner attached onto the hair-like members 23 of the brush roller 21 is removed. The construction of a toner classifying device of FIG. 7 is substantially the same as that illustrated in FIGS. 2A and 2B with the exception of the flicker 40.

Figure 8:
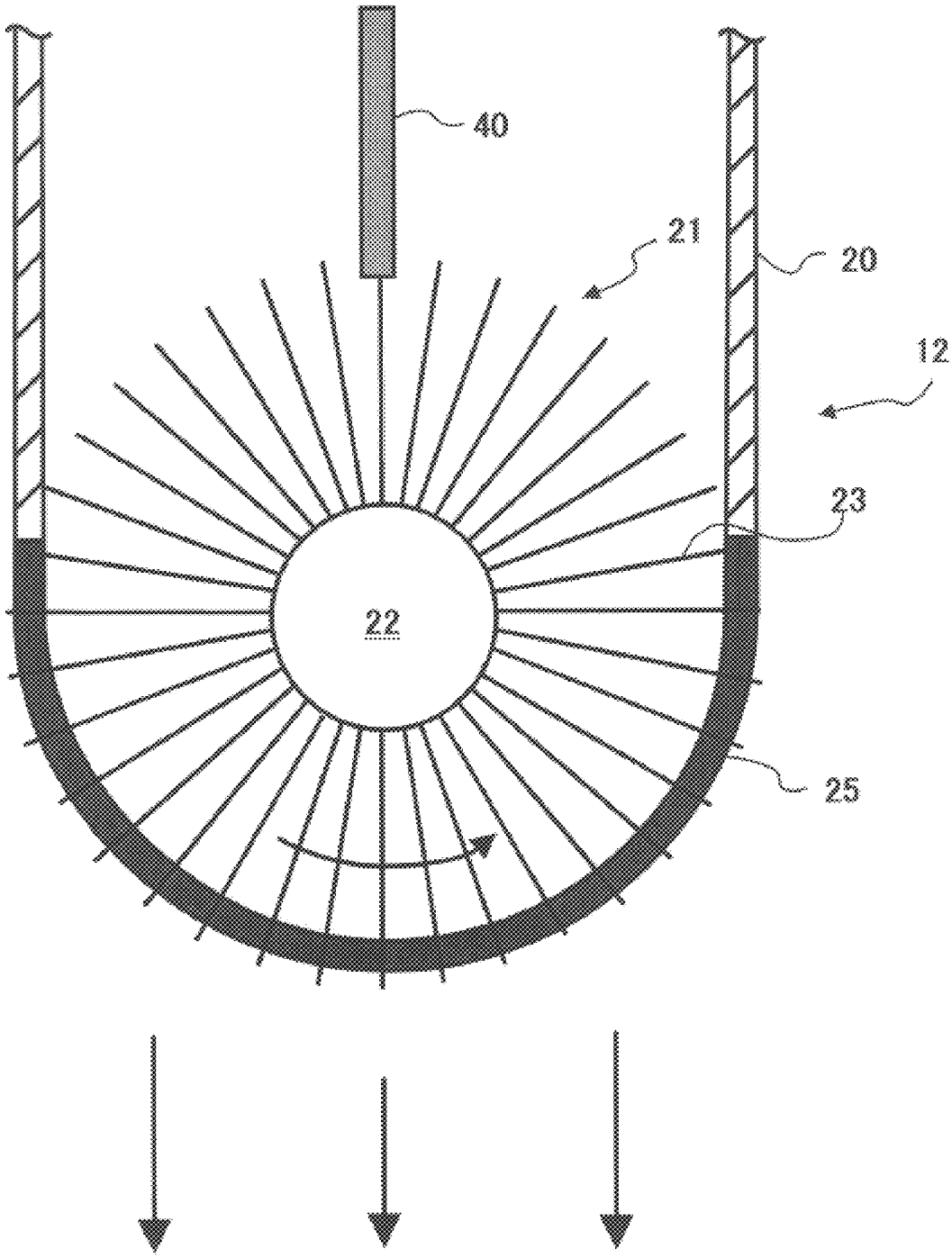
FIG. 8 is a cross sectional view of a main part of the toner classifying device and a flicker having an alternative shape.

As a non-limiting example of the flicker 40, the flicker 40 may be in a shape of a blade as illustrated in FIG. 8 instead of the bar-shaped flicker 40 illustrated in FIG. 7. The toner is likely to attach onto the hair-like members 23 of the brush roller 21. The hair-like members 23 are elastically deformed by the contact of the flicker 40, and return to an original shape due to their elastic force, thereby causing the toner attached onto the hair-like members 23 to remove therefrom. Owing to the flicker 40, the toner classifying function of the brush roller 21 may be maintained for a relatively long time. When toner is attached onto the tip end portions of the hair-like members 23, it is difficult to penetrate the tip end portions of the hair-like members 23 into the meshes of the mesh member 25, thereby suppressing the function of the hair-like members 23 to prevent clogging of the meshes of the mesh member 25 with toner. Therefore, the flicker 40 effectively serves to maintain the toner classifying function of the brush roller 21.

Figure 9B:
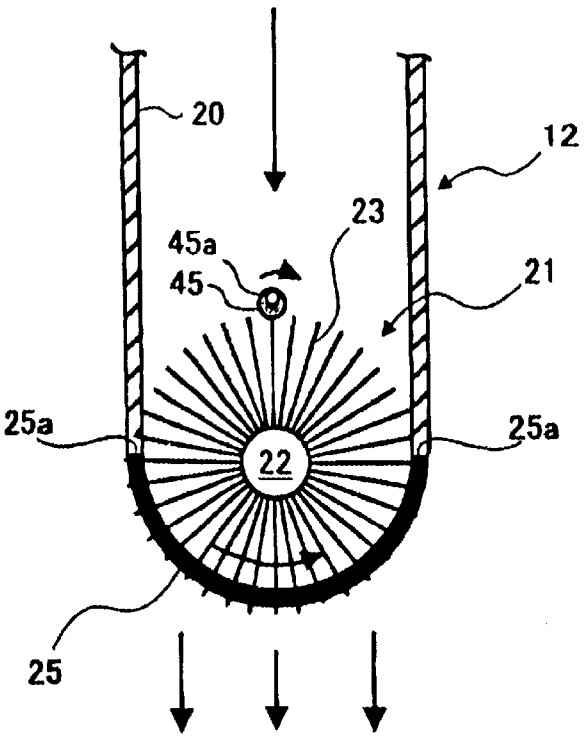
FIG. 9B is a cross sectional view taken along line 9*b*—9*b* of FIG. 9A.
Figure 9A:
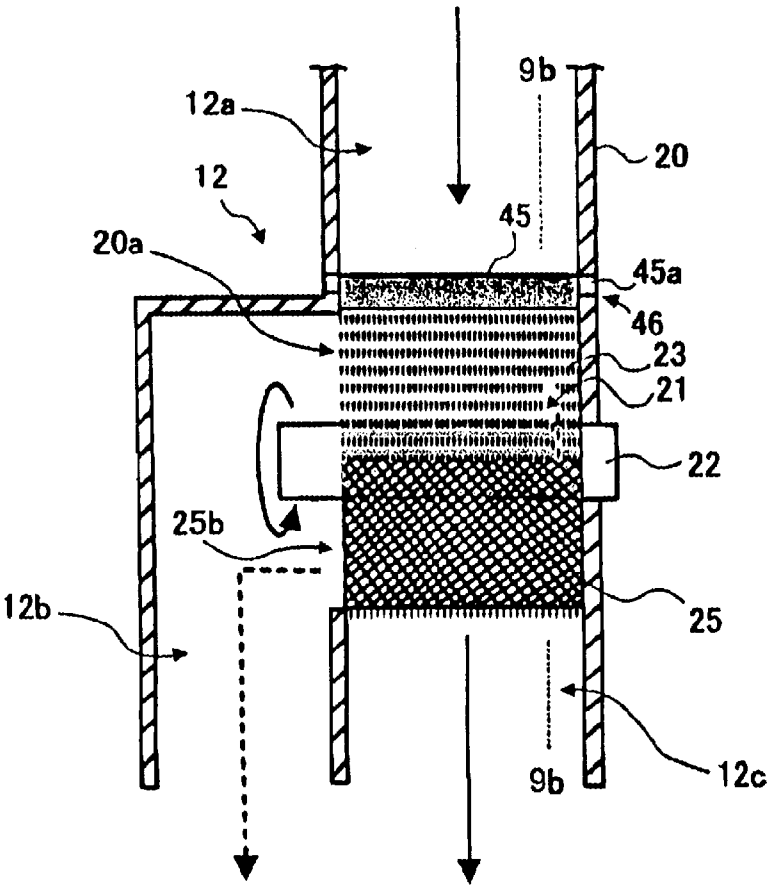
FIG. 9A is a cross sectional view of a main part of the toner classifying device taken in a direction substantially perpendicular to the axial direction of the photoreceptor.

FIG. 9A is a cross sectional view of a main part of the toner classifying device 12 taken in a direction substantially perpendicular to the axial direction of the photoreceptor 1 according to another embodiment of the present invention. FIG. 9B is a cross sectional view taken along line 9*b*—9*b* of FIG. 9A.

As an alternative to the flicker 40 illustrated in FIGS. 7 and 8 that is fixedly provided, a flicker 45 is rotatably provided in this another embodiment. Specifically, the flicker 45, formed from a stainless bar or other similar materials, is rotatably supported by a bearing portion 46 about a shaft 45*a* which is provided in parallel with the brush roller shaft 22 of the brush roller 21. The shaft 45*a* is an eccentric shaft in this embodiment.

When the flicker 45 is rotatively provided, the flicker 45 is rotated by rotating the brush roller 21 in contact with the flicker 45, thereby decreasing the frictional resistance between the flicker 45 and the surface portions of the hair-like members 23 of the brush roller 21. As a result, the useful lifetime of the brush roller 21 may be extended by suppressing the abrasion of the surface portions of the hair-like members 23 of the brush roller 21. The construction of the toner classifying device 12 of FIGS. 9A and 9B is substantially the same as that of the toner classifying device 12 illustrated in FIGS. 2A and 2B with the exception of the flicker 45 and the bearing portion 46.

Figure 10B:
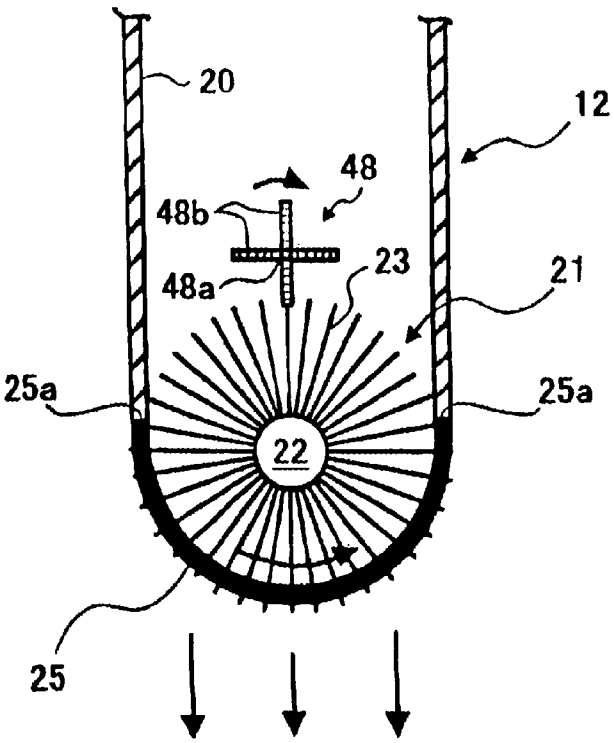
FIG. 10B is a cross sectional view taken along line 10*b*—10*b* of FIG. 10A.
Figure 10A:
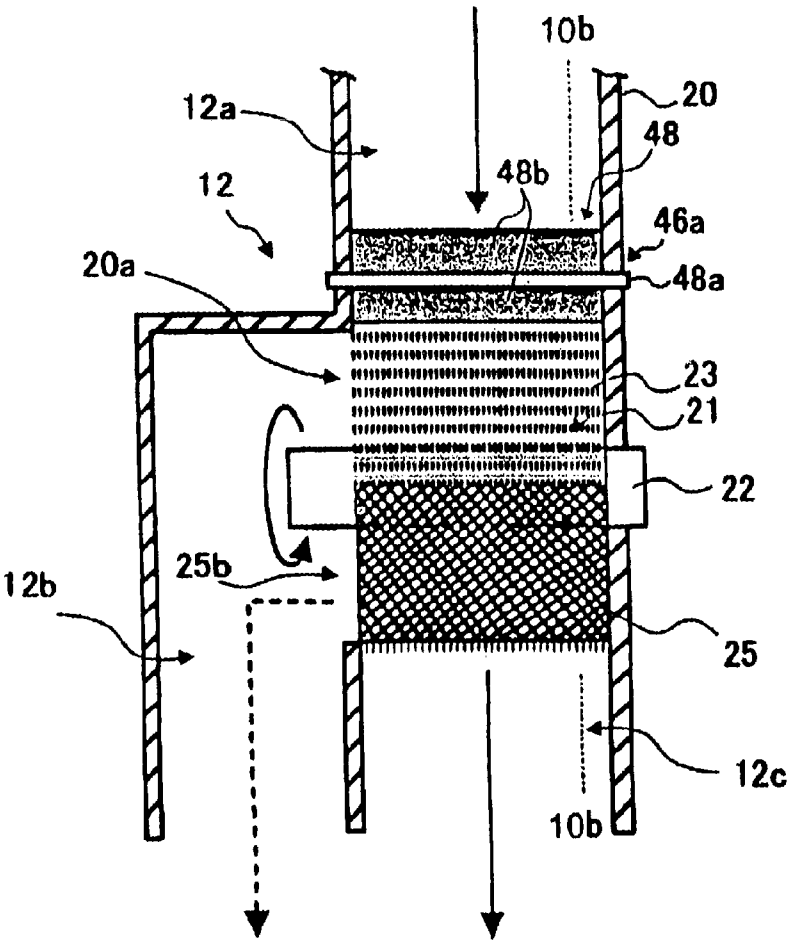
FIG. 10A is a cross sectional view of a main part of the toner classifying device taken in a direction substantially perpendicular to the axial direction of the photoreceptor.

FIG. 10A is a cross sectional view of a main part of the toner classifying device 12 taken in a direction substantially perpendicular to the axial direction of the photoreceptor 1. FIG. 10B is a cross sectional view taken along ling 10*b*—10*b* of FIG. 10A. As illustrated in FIGS. 10A and 10B, a flicker 48 is formed by combining blade-shaped flickers 40, illustrated in FIG. 8, into a cruciform cross section. The flicker 48 is constructed so that a shaft 48*a* of the flicker 48 arranged in parallel with the brush roller shaft 22 is rotatably supported by a bearing portion 46*a,* and the flicker 48 is rotated by rotating the brush roller 21 in contact with the flicker 48. According to this another embodiment of the present invention, a plurality of blade plates 48*b* of the flicker 48 contact the surface portions of the hair-like members 23 of the brush roller 21 when rotating the brush roller 21. Therefore, the ability of removing toner from the surface portions of the hair-like members 23 of the brush roller 21 is higher than that of the flicker 45 of FIGS. 9A and 9B. The construction of the toner classifying device 12 of FIGS. 10A and 10B are substantially the same as that of the toner classifying device 12 illustrated in FIGS. 2A and 2B, with the exception of the flicker 48 and the bearing portion 46*a*.

Figure 11B:
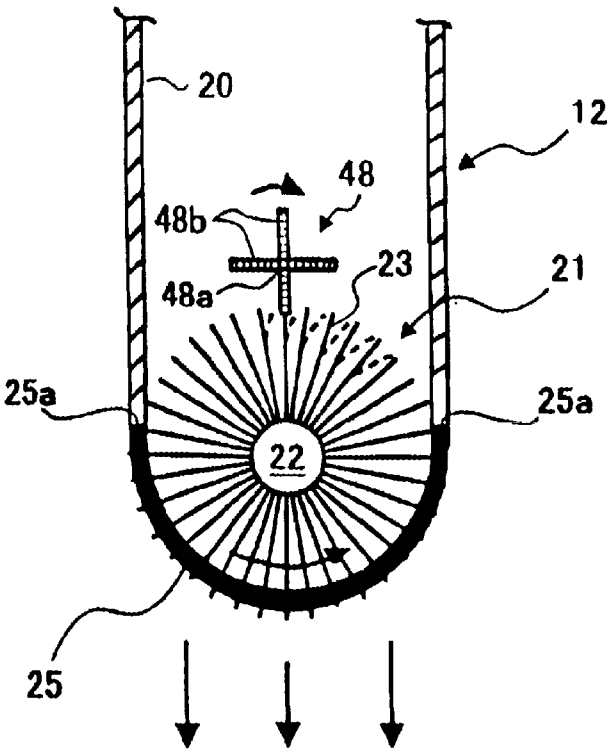
FIG. 11B is a cross sectional view taken along line 11*b*—11*b* of FIG. 11A.
Figure 11A:
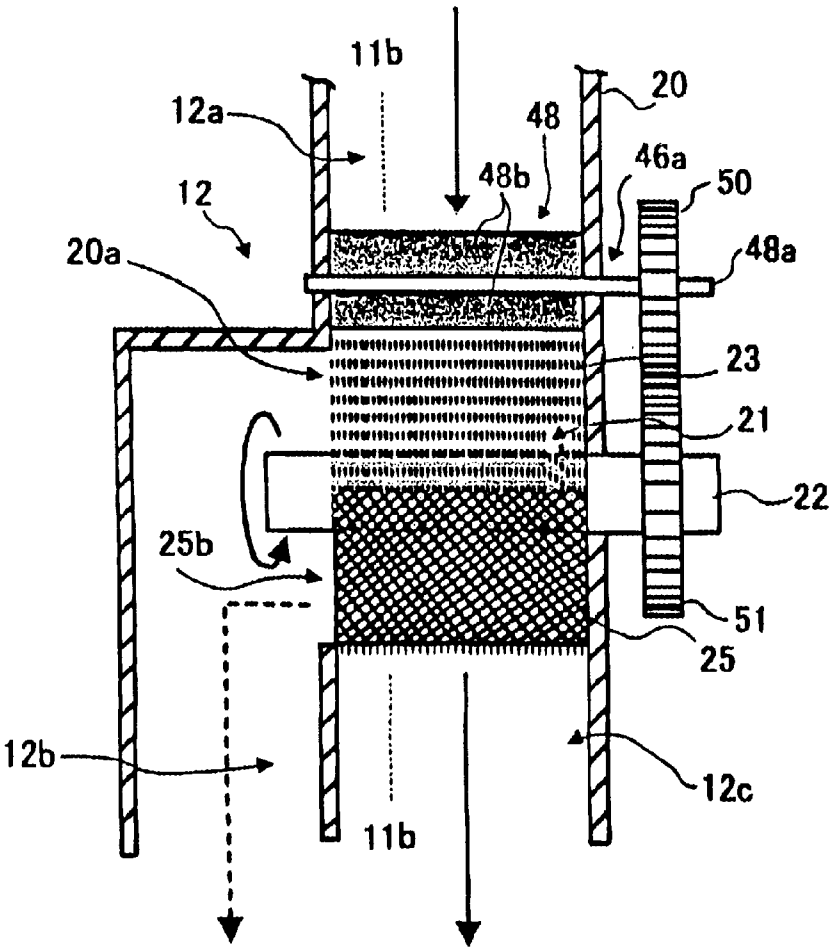
FIG. 11A is a cross sectional view of a main part of the toner classifying device taken in a direction substantially perpendicular to the axial direction of the photoreceptor according to an alternative example.

FIGS. 11A and 11B illustrate an alternative example of the toner classifying device 12 of FIGS. 10A and 10B. FIG. 11A is a cross sectional view of a main part of the toner classifying device 12 taken in a direction substantially perpendicular to the axial direction of the photoreceptor 1 according to an alternative example. FIG. 11B is a cross sectional view taken along line 11*b*—11*b* of FIG. 11A. In this alternative example, the flicker 48 is constructed so that the flicker 48 is rotated at a different circumferential velocity from that of the brush roller 21. As illustrated in FIG. 11A, a gear 50 is provided to one side of the shaft 48*a* of the flicker 48, and a gear 51 is provided to one side of the brush roller shaft 22 of the brush roller 21. The gears 50 and 51 having different diameters engage with each other. In this construction, when rotating the brush roller 21 by the brush roller drive motor 200, the flicker 48 is driven to rotate via the gears 51 and 50. Thereby, the flicker 48 and the brush roller 21 are rotated at different circumferential velocities. Specifically, the circumferential velocity of the flicker 48 is faster than that of the brush roller 21.

By rotating the flicker 48 and the brush roller 21 at different circumferential velocities, as described above, the hair-like members 23 of the brush roller 21 are whisked in a direction opposite to their slanting direction by the flicker 48, so that the slanting of the hair-like members 23 can be corrected.

Further, by changing the difference of the circumferential velocities between the brush roller 21 and the flicker 48, the relation between the ability of the flicker 48 to remove toner attached onto the brush roller 21 and the slanting of the hair-like members 23 of the brush roller 21 may be adjusted adequately.

Figure 12:
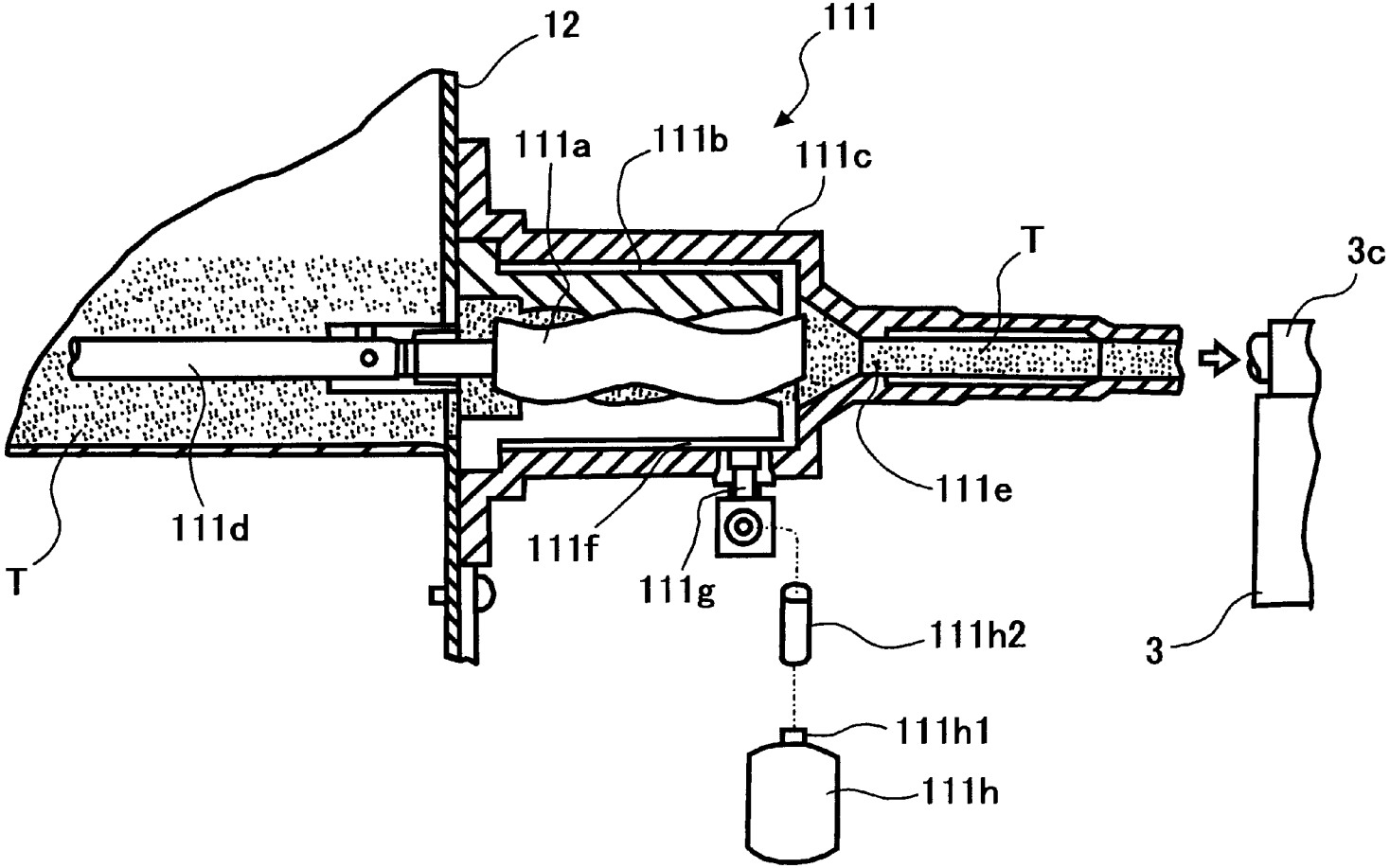
FIG. 12 is a cross sectional view of a toner conveying device according to an alternative example.

Next, an alternative example of the toner conveying device 13 of the toner recycling device 11 illustrated in FIG. 1 will be described. FIG. 12 is a cross sectional view of a toner conveying device according to an alternative example. In this example, a toner conveying device includes an air pump instead of the coil (screw). In the toner conveying device 13 of FIG. 1, reusable toner is conveyed to the developing device 3 by rotations of the coils provided in the toner conveying device 13. In the toner conveying device of FIG. 12, toner classified in the toner classifying device 12 is conveyed to the developing device 3 by an air pump and a flexible pipe. Specifically, reusable toner T is conveyed to the developing device 3 by a powder pump unit 111. A toner conveying path of the toner conveying device is preferably formed from a material having flexibility and toner-resisting property, such as nylon, Teflon (trade mark), and other similar materials.

When conveying toner by use of the coil (screw), the property of toner may be changed due to the friction between the toner and the coil (screw). On the other hand, when conveying toner by use of the powder pump unit 111, the change of the property of toner is typically suppressed.

The powder pump unit 111 employs a screw pump of so-called moineau pump and includes a rotor 111*a*, a stator 111*b*, and a holder 111*c*. The rotor 111*a* is engaged with a drive motor (not shown) as a driving source via a drive shaft of a toner conveying screw 111*d*, and is driven to rotate by rotating the drive motor. Specifically, the powder pump unit 111 includes the rotor 111*a* connected to the drive motor via the drive shaft of the toner conveying screw 111*d*, the stator 111*b* formed from an elastic body such as rubber material and fixed surrounding the rotor 111*a*, and the holder 111*c* holding the stator 111*b*. In the toner conveying device, classified toner at a lower portion of the toner classifying device 12 is taken in by the toner conveying screw 111*d*, and is conveyed to a toner conveying path 111*e* by rotating the rotor 111*a*.

A gap 111*f* of, for example, about 1 mm is formed between a side surface of the stator 111*b* and an inner side surface of the holder 111*c*, and communicates with the toner conveying path 111*e*. The powder pump unit 111 further includes a gas pump 111*h*, a gas supply tube 111*h*2, and a gas supply opening 111*g*.

The gas supply opening 111*g* communicates with the toner conveying path 111*e*, and communicates with the gas pump 111*h* through the gas supply tube 111*h*2 and a gas discharge opening 111*h*1 provided with the gas pump 111*h*.

When the gas pump 111*h* is actuated, air is injected into reusable toner T in the toner conveying path 111*e* through the gas supply tube 111*h*2, the gas supply opening 111*g*, and the gap 111*f*, at an air blasting amount of about 0.5–1.0 liters/minute, for example. With the above-described construction of the powder pump unit 111, the fluidity of the reusable toner Tin the toner conveying path 111*e* is enhanced. The reusable toner T mixed with air is discharged from the toner conveying path 111*e* to the toner hopper 3*c* of the developing device 3 so as to be reused for subsequent development.

According to the embodiments of the present invention, the toner classifying device 12 classifies toner with simple construction for reuse. In the toner classifying device 12, paper powder and aggregated small toner may be removed from the toner removed from the photoreceptor 1 by the cleaning device 5 without causing the meshes of the mesh member 25 to be clogged.

Further, in the image forming apparatus according to the embodiments of the present invention, effective use of resources may be achieved by recycling toner, and occurrence of deterioration of image can be suppressed.

The present invention has been described with respect to the embodiments illustrated in the figures. However, the present invention is not limited to those embodiments and may be practiced otherwise.

For example, the above-described toner recycling device 11 including the toner classifying device 12 and the toner conveying device 13 may be employed in an electrophotographic image forming process cartridge wherein a photoreceptor, a developing device, a cleaning device, and other similar devices are integrally accommodated in a case.

Further, in the above-described embodiments of the present invention, the toner classified in the toner classifying device 12 is conveyed to the developing device 3. Alternatively, it can be configured that the toner classified in the toner classifying device 12 is replenished to a toner bank including a plurality of toner bottles so as to mix with new toner. Subsequently, the recycled toner mixed with new toner is supplied to the developing device 3 from the toner bank.

The present invention can be applied to any image forming apparatuses such as a copying machine, a printer, and a facsimile machine.

Numerous additional modifications and variations of the present invention are possible in light of the above teachings. It is therefore to be understood that within the scope of the appended claims, the present invention may be practiced otherwise than as specifically described herein.

What is claimed as new and is desired to be secured by Letters Patent of the United States is:

1. A powder classifying device that classifies powder, comprising:

a mesh member including meshes; and a brush roller formed with hair-like members and configured to rotate in sliding contact with the mesh member at a predetermined portion in a circumferential direction of the brush roller to push the powder conveyed in a radial direction of the brush roller against the meshes so that the powder is classified into powder passing through the meshes and powder not passing through the meshes, wherein the hair-like members of the brush roller have conductivity.

2. The powder classifying device according to claim 1, further comprising a powder conveying device configured to convey the powder passed through the meshes.

3. The powder classifying device according to claim 1, wherein the brush roller is further configured to move the powder not passing through the meshes, in an axial direction of the brush roller.

4. The powder classifying device according to claim 3, wherein surface portions of the hair-like members of the brush roller are slanted in the axial direction of the brush roller in which the powder not passing through the meshes is moved relative to a rotational direction of the brush roller.

5. The powder classifying device according to claim 1, wherein each of the hair-like members of the brush roller is substantially straight, and has a thickness smaller than a size of each of the meshes of the mesh member.

6. The powder classifying device according to claim 1, further comprising:

a drive device configured to drive the brush roller to rotate; and a control device configured to control the brush roller to rotate in forward and reverse directions.

7. The powder classifying device according to claim 1, further comprising a contact member configured to contact the hair-like members of the brush roller.

8. The powder classifying device according to claim 7, further comprising a supporting member configured to rotatably support the contact member.

9. The powder classifying device according to claim 7, further comprising a device configured to rotate the brush roller and the contact member at different circumferential velocities.

10. The powder classifying device according to claim 1, wherein the powder is toner.

11. An image forming apparatus, comprising:

an image bearing member configured to bear a latent image;

a developing device configured to develop the latent image with powder so as to form a visual image;

a cleaning device configured to remove the powder remaining on the image bearing member;

a powder classifying device configured to classify the powder removed from the image bearing member by the cleaning device, including:

a mesh member including meshes; and a brush roller formed with hair-like members and configured to rotate in sliding contact with the mesh member at a predetermined portion in a circumferential direction of the brush roller to push the powder conveyed in a radial direction of the brush roller against the meshes so that the powder is classified into powder passing through the meshes and powder not passing through the meshes, wherein the hair-like members of the brush roller have conductivity; and a powder conveying device configured to convey the powder passed through the meshes so as to mix with new powder.

12. The image forming apparatus according to claim 11, wherein the brush roller is further configured to move the powder not passing through the meshes, in an axial direction of the brush roller.

13. The image forming apparatus according to claim 12, further comprising a powder conveying path configured to dispose of the powder not passing through the meshes and moved in the axial direction of the brush roller.

14. The image forming apparatus according to claim 12, wherein surface portions of the hair-like members of the brush roller are slanted in the axial direction of the brush roller in which the powder not passing through the meshes is moved relative to a rotational direction of the brush roller.

15. The image forming apparatus according to claim 11, wherein each of the hair-like members of the brush roller is substantially straight and is a thickness smaller than a size of each of the meshes of the mesh member.

16. The image forming apparatus according to claim 11, further comprising:

a drive device configured to drive the brush roller to rotate; and a control device configured to control the brush roller to rotate in forward and reverse directions.

17. The image forming apparatus according to claim 11, further comprising a contact member configured to contact the hair-like members of the brush roller.

18. The image forming apparatus according to claim 17, further comprising a supporting member configured to rotatably support the contact member.

19. The image forming apparatus according to claim 17, further comprising a device configured to rotate the brush roller and the contact member at different circumferential velocities.

20. The image forming apparatus according to claim 11, wherein the powder is toner removed from the image bearing member.

21. An image forming apparatus, comprising:

bearing means for bearing a latent image;

developing means for developing the latent image with powder so as to form a visual image;

removing means for removing the powder remaining on the bearing means;

classifying means for classifying the powder removed from the bearing means via the removing means, including:

a mesh member including meshes; and rotating means for rotating in sliding contact with the mesh member at a predetermined portion in a circumferential direction of the rotating means to push the powder conveyed in a radial direction of the rotating means against the meshes so that the powder is classified into powder passing through the meshes and powder not passing through the meshes, the rotating means being formed with hair-like members, wherein the hair-like members of the brush roller have conductivity; and conveying means for conveying the powder passed through the meshes so as to be mixed with new powder.

22. The image forming apparatus according to claim 21, further comprising:

driving means for driving the rotating means to rotate; and control means for controlling the rotating means to rotate in forward and reverse directions.

23. The image forming apparatus according to claim 21, further comprising contact means for contacting the hair-like members of the rotating means.

24. The image forming apparatus according to claim 23, further comprising support means for rotatably supporting the contact means.

25. The image forming apparatus according to claim 23, further comprising variable rotation means for variably rotating the rotating means and the contact means at different circumferential velocities.

26. A method of classifying powder, comprising the steps of:

providing a brush roller having hair-like members with conductivity;

conveying powder to the brush roller in a radial direction of the brush roller;

rotating the brush roller in sliding contact with meshes of a mesh member; and pushing the powder against the meshes of the mesh member.

27. The method according to claim 26, further comprising the step of moving the powder not passing through the meshes in an axial direction of the brush roller.

28. The method according to claim 26, wherein the step of rotating the brush roller comprises controlling the brush roller to rotate in forward and reverse directions.

29. A powder classifying device that classifies powder, comprising:

a mesh member including meshes; and a brush roller formed with hair-like members and configured to rotate in sliding contact with the mesh member at a predetermined portion in a circumferential direction of the brush roller to push the powder conveyed in a radial direction of the brush roller against the meshes so that the powder is classified into powder passing through the meshes and powder not passing through the meshes, wherein the brush roller is further configured to move the powder not passing through the meshes, in an axial direction of the brush roller, and wherein surface portions of the hair-like members of the brush roller are slanted in the axial direction of the brush roller in which the powder not passing through the meshes is moved relative to a rotational direction of the brush roller.

30. A powder classifying device that classifies powder, comprising:

a mesh member including meshes; and a brush roller formed with hair-like members and configured to rotate in sliding contact with the mesh member at a predetermined portion in a circumferential direction of the brush roller to push the powder conveyed in a radial direction of the brush roller against the meshes so that the powder is classified into powder passing through the meshes and powder not passing through the meshes, wherein the hair-like members of the brush roller have conductivity;

a drive device configured to drive the brush roller to rotate; and a control device configured to control the brush roller to rotate in forward and reverse directions.

31. A powder classifying device that classifies powder, comprising:

a mesh member including meshes; and a brush roller formed with hair-like members and configured to rotate in sliding contact with the mesh member at a predetermined portion in a circumferential direction of the brush roller to push the powder conveyed in a radial direction of the brush roller against the meshes so that the powder is classified into powder passing through the meshes and powder not passing through the meshes, wherein the hair-like members of the brush roller have conductivity; and a contact member configured to contact the hair-like members of the brush roller.

32. The powder classifying device according to claim 31, further comprising a supporting member configured to rotatably support the contact member.

33. The powder classifying device according to claim 31, further comprising a device configured to rotate the brush roller and the contact member at different circumferential velocities.

34. An image forming apparatus, comprising:

an image bearing member configured to bear a latent image;

a developing device configured to develop the latent image with powder so as to form a visual image;

a cleaning device configured to remove the powder remaining on the image bearing member;

a powder classifying device configured to classify the powder removed from the image bearing member by the cleaning device, including:

a mesh member including meshes; and a brush roller formed with hair-like members and configured to rotate in sliding contact with the mesh member at a predetermined portion in a circumferential direction of the brush roller to push the powder conveyed in a radial direction of the brush roller against the meshes so that the powder is classified into powder passing through the meshes and powder not passing through the meshes, wherein the brush roller is further configured to move the powder not passing through the meshes, in an axial direction, and wherein surface portions of the hair-like members of the brush roller are slanted in the axial direction of the brush roller in which the powder not passing through the meshes is moved relative to a rotational direction of the brush roller; and a powder conveying device configured to convey the powder passed through the meshes so as to mix with new powder.

35. An image forming apparatus, comprising:

an image bearing member configured to bear a latent image;

a developing device configured to develop the latent image with powder so as to form a visual image;

a cleaning device configured to remove the powder remaining on the image bearing member;

a powder classifying device configured to classify the powder removed from the image bearing member by the cleaning device, including:

a mesh member including meshes;

a brush roller formed with hair-like members and configured to rotate in sliding contact with the mesh member at a predetermined portion in a circumferential direction of the brush roller to push the powder conveyed in a radial direction of the brush roller against the meshes so that the powder is classified into powder passing through the meshes and powder not passing through the meshes;

a drive device configured to drive the brush roller to rotate; and a control device configured to control the brush roller to rotate in forward and reverse directions; and a powder conveying device configured to convey the powder passed through the meshes so as to mix with new powder.

36. An image forming apparatus, comprising:

an image bearing member configured to bear a latent image;

a developing device configured to develop the latent image with powder so as to form a visual image;

a cleaning device configured to remove the powder remaining on the image bearing member;

a powder classifying device configured to classify the powder removed from the image bearing member by the cleaning device, including:

a mesh member including meshes;

a brush roller formed with hair-like members and configured to rotate in sliding contact with the mesh member at a predetermined portion in a circumferential direction of the brush roller to push the powder conveyed in a radial direction of the brush roller against the meshes so that the powder is classified into powder passing through the meshes and powder not passing through the meshes; and a contact member configured to contact the hair-like members of the brush roller; and a powder conveying device configured to convey the powder passed through the meshes so as to mix with new powder.

37. The image forming apparatus according to claim 36, further comprising a supporting member configured to rotatably support the contact member.

38. The image forming apparatus according to claim 36, further comprising a device configured to rotate the brush roller and the contact member at different circumferential velocities.

39. An image forming apparatus, comprising:

bearing means for bearing a latent image;

developing means for developing the latent image with powder so as to form a visual image;

removing means for removing the powder remaining on the bearing means;

classifying means for classifying the powder removed from the bearing means via the removing means, including:

a mesh member including meshes;

rotating means for rotating in sliding contact with the mesh member at a predetermined portion in a circumferential direction of the rotating means to push the powder conveyed in a radial direction of the rotating means against the meshes so that the powder is classified into powder passing through the meshes and powder not passing through the meshes, the rotating means being formed with hair-like members;

driving means for driving the rotating means to rotate; and control means for controlling the rotating means to rotate in forward and reverse directions; and conveying means for conveying the powder passed through the meshes so as to be mixed with new powder.

40. An image forming apparatus, comprising:

bearing means for bearing a latent image;

developing means for developing the latent image with powder so as to form a visual image;

removing means for removing the powder remaining on the bearing means;

classifying means for classifying the powder removed from the bearing means via the removing means, including:

a mesh member including meshes;

rotating means for rotating in sliding contact with the mesh member at a predetermined portion in a circumferential direction of the rotating means to push the powder conveyed in a radial direction of the rotating means against the meshes so that the powder is classified into powder passing through the meshes and powder not passing through the meshes, the rotating means being formed with hair-like members; and contact means for contacting the hair-like members of the rotating means; and conveying means for conveying the powder passed through the meshes so as to be mixed with new powder.

41. The image forming apparatus according to claim 40, further comprising support means for rotatably supporting the contact means.

42. The image forming apparatus according to claim 40, further comprising variable rotation means for variably rotating the rotating means and the contact means at different circumferential velocities.

43. A method of classifying powder, comprising the steps of:

conveying powder to a brush roller in a radial direction of the brush roller;

rotating the brush roller in sliding contact with meshes of a mesh member, wherein the rotating of the brush roller includes controlling the brush roller to rotate in forward and reverse directions; and pushing the powder against the meshes of the mesh member.

* * * * *